US009437140B2

(12) United States Patent
Ota et al.

(10) Patent No.: US 9,437,140 B2
(45) Date of Patent: Sep. 6, 2016

(54) ELECTRO-OPTICAL DEVICE AND ELECTRONIC APPARATUS

(71) Applicant: SEIKO EPSON CORPORATION, Tokyo (JP)

(72) Inventors: Hitoshi Ota, Shiojiri (JP); Masanori Iwasaki, Shiojiri (JP); Makiko Takahashi, Tokyo (JP)

(73) Assignee: SEIKO EPSON CORPORATION, Tokyo (JP)

( * ) Notice: Subject to any disclaimer, the term of this patent is extended or adjusted under 35 U.S.C. 154(b) by 30 days.

(21) Appl. No.: 14/593,252

(22) Filed: Jan. 9, 2015

(65) Prior Publication Data

US 2015/0213763 A1 Jul. 30, 2015

(30) Foreign Application Priority Data

Jan. 29, 2014 (JP) ..... 2014-014087
Aug. 28, 2014 (JP) ..... 2014-173624

(51) Int. Cl.
*G09G 3/32* (2016.01)

(52) U.S. Cl.
CPC ..... *G09G 3/3266* (2013.01); *G09G 2330/04* (2013.01); *G09G 2330/12* (2013.01)

(58) Field of Classification Search
CPC ..... G09G 3/3233; G09G 3/3258; G09G 3/3607; G09G 2300/0439; G09G 2300/0456; G09G 2300/046; G09G 2300/0465; G09G 2300/0469; G09G 2300/0473; G09G 2300/08; G09G 2310/0278; G09G 2310/0245; G09G 2310/063; G09G 3/30; G09G 3/3208; G09G 3/3216; G09G 3/3225; G09G 3/3241; G09G 2300/0421; G09G 3/3291; G09G 3/3433; G09G 3/3266; G09G 2330/04; G09G 2330/12; G06F 3/012; G06F 3/013; G06F 3/014; G06F 3/0346; G06F 3/0304; G06F 3/0386; G06F 3/0421; G06F 2203/04101; G02B 27/0093; G02B 27/01; G06T 7/0042; G06T 2207/10016; G06T 2207/30204

See application file for complete search history.

(56) References Cited

U.S. PATENT DOCUMENTS 6,337,722 B1 * 1/2002 Ha ..... G02F 1/136204 257/360
2005/0088106 A1 * 4/2005 Suh ..... G09G 3/3208 315/169.3

(Continued)

FOREIGN PATENT DOCUMENTS

JP 2001291585 A 10/2001
JP 2004287032 A 10/2004

(Continued)

*Primary Examiner* — Lun-Yi Lao
*Assistant Examiner* — Jarurat Suteerawongsa
(74) *Attorney, Agent, or Firm* — Oliff PLC

(57) ABSTRACT

An electro-optical device including a substrate; an array region which is formed on the substrate and in which a plurality of light emitting pixels are arranged two-dimensionally; first drive lines that are arranged in a row direction and are connected to each of the light emitting pixels; second drive lines that are arranged in a column direction and are connected to each of the light emitting pixels; a drive circuit that supplies a drive signal to at least one of the first drive line and the second drive line; an inspection terminal that is electrically connected to the drive circuit or the second drive lines; and an electrostatic protection circuit that is connected to the inspection terminal, in which at least a part of the electrostatic protection circuit overlaps the inspection terminal in a plan view.

14 Claims, 8 Drawing Sheets

(56) References Cited

U.S. PATENT DOCUMENTS

| | | | | |
|---|---|---|---|---|
| 2006/0001792 | A1 | 1/2006 | Choi | |
| 2009/0108738 | A1* | 4/2009 | Kwak | G09G 3/3208 313/504 |
| 2010/0220071 | A1* | 9/2010 | Nishihara | G06F 3/0416 345/173 |

FOREIGN PATENT DOCUMENTS

| | | | |
|---|---|---|---|
| JP | 2006013444 | A | 1/2006 |
| JP | 2007192959 | A | 8/2007 |
| JP | 2010160950 | A | 7/2010 |

* cited by examiner

ELECTRO-OPTICAL DEVICE AND ELECTRONIC APPARATUS

BACKGROUND

1. Technical Field

The present invention relates to an electro-optical device and an electronic apparatus.

2. Related Art

In the related art, as an electro-optical device, for example, in an organic electroluminescent device (hereinafter, referred to as an organic EL device), an element substrate in which a light emitting element (hereinafter, also referred to as an organic EL element) that is a light emitting pixel and a circuit that drives the organic EL element are formed is provided with an inspection terminal for inspecting the organic EL element and the drive circuit in a manufacturing process and an external connection terminal for connection to an external circuit. In the manufacturing process of the organic EL device, electrical characteristics of the organic EL element and the drive circuit are measured using the inspection terminal and a failure is detected early. Meanwhile, after completion of the organic EL device, in a state where the inspection terminal is exposed, the drive circuit fails due to static electricity penetrating from outside through the inspection terminal and this is a cause of malfunction of the drive circuit. Thus, the malfunction is prevented by forming a protective film, for example, a resin layer on the inspection terminal (for example, JP-A-2010-160950).

However, scratches caused by a probe being brought into contact with the inspection terminal occur during inspection and defects are generated in the protective film covering the inspection terminal due to irregularities formed on a surface of the inspection terminal. If the protective film is damaged, static electricity may enter the inspection terminal and cause electrostatic breakdown of the organic EL element or the drive circuit. Thus, the protective film alone is insufficient to reduce or prevent electrostatic breakdown.

SUMMARY

An advantage of some aspects of the invention is to provide an electro-optical device and an electronic apparatus that can reliably prevent electrostatic breakdown of a light emitting element or a drive circuit.

The invention can be realized in the following forms or application examples.

APPLICATION EXAMPLE 1

According to this application example, there is provided an electro-optical device including: a substrate; an array region which is formed on the substrate and in which a plurality of light emitting pixels are arranged two-dimensionally; a first drive line connected to light emitting pixels that are arranged in a row direction; a second drive line connected to light emitting pixels that are arranged in a column direction; a drive circuit that supplies a drive signal to at least one of the first drive line and the second drive line; an inspection terminal that is electrically connected to the drive circuit or the second drive line; and an electrostatic protection circuit that is connected to the inspection terminal, in which at least a part of the electrostatic protection circuit overlaps the inspection terminal in a plan view.

In this case, since the electrostatic protection circuit is connected to the inspection terminal connected to the drive circuit or the second drive lines, it is possible to reduce or prevent electrostatic breakdown of the light emitting pixels (light emitting elements) or the drive circuit. Furthermore, since the inspection terminal and the electrostatic protection circuit overlap in a plan view, it is possible to reduce the size of an entire device.

APPLICATION EXAMPLE 2

In the electro-optical device according to the application example, it is preferable that a surface of the inspection terminal be covered by an insulating sealing film.

In this case, it is possible to reduce or prevent the breakage of the light emitting pixels or the drive circuit due to penetration of static electricity from the inspection terminal.

APPLICATION EXAMPLE 3

In the electro-optical device according to the application example, it is preferable that the electrostatic protection circuit have a shape having an area larger than an area of the inspection terminal in a plan view.

In this case, it is possible to increase performance of the electrostatic protection circuit.

APPLICATION EXAMPLE 4

It is preferable that the electro-optical device according to the application example further include: a mounting terminal that is formed in a region different from the array region on the substrate, in which the inspection terminal is disposed on a side different from a side on which the mounting terminal of the substrate having a rectangular shape is disposed.

In this case, if the inspection terminal and the mounting terminal are simultaneously provided on the same substrate, it is possible to effectively use the substrate by providing the inspection terminal on the side different from the mounting terminal. Furthermore, it is easy to form the sealing film for exposing the mounting terminal by providing the inspection terminal in the region different from the mounting terminal.

APPLICATION EXAMPLE 5

In the electro-optical device according to the application example, it is preferable that inspection terminals be disposed on three other sides different from the side on which the mounting terminal is disposed.

In this case, it is possible to provide a plurality of inspection terminals.

APPLICATION EXAMPLE 6

In the electro-optical device according to the application example, it is preferable that the electrostatic protection circuit be formed in a layer lower than the inspection terminal, and a plurality of insulating layers exist between the electrostatic protection circuit and the inspection terminal which overlap in a plan view.

In this case, even if stress is applied to the inspection terminal during inspection, the electrostatic protection circuit of the lower layer is unlikely to be affected and it is possible to reduce or prevent the breakage of the electrostatic protection circuit.

APPLICATION EXAMPLE 7

In the electro-optical device according to the application example, it is preferable that the electrostatic protection circuit have a transistor, and a source of the transistor be connected to the inspection terminal, and a gate and a drain be connected to a substrate potential.

In this case, the electrostatic protection circuit may have the transistor connected to a diode, and the source of the transistor may be connected to the inspection terminal, and the gate and the drain may be connected to the substrate potential. Thus, it is possible to reliably reduce or prevent the electrostatic breakdown of the light emitting pixels or the drive circuit so that the transistor functions as the diode.

APPLICATION EXAMPLE 8

According to this application example, there is provided an electronic apparatus including the electro-optical device described above.

In this case, since the electro-optical device having the structure to reduce or prevent the electrostatic breakdown is included, it is possible to provide the electronic apparatus having high reliability.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodied embodiments of the invention will be described with reference to the drawings. Moreover, the drawings used are appropriately enlarged or reduced so that a describing portion thereof is in a recognizable state.

First Embodiment

Organic EL Device

Figure 1:
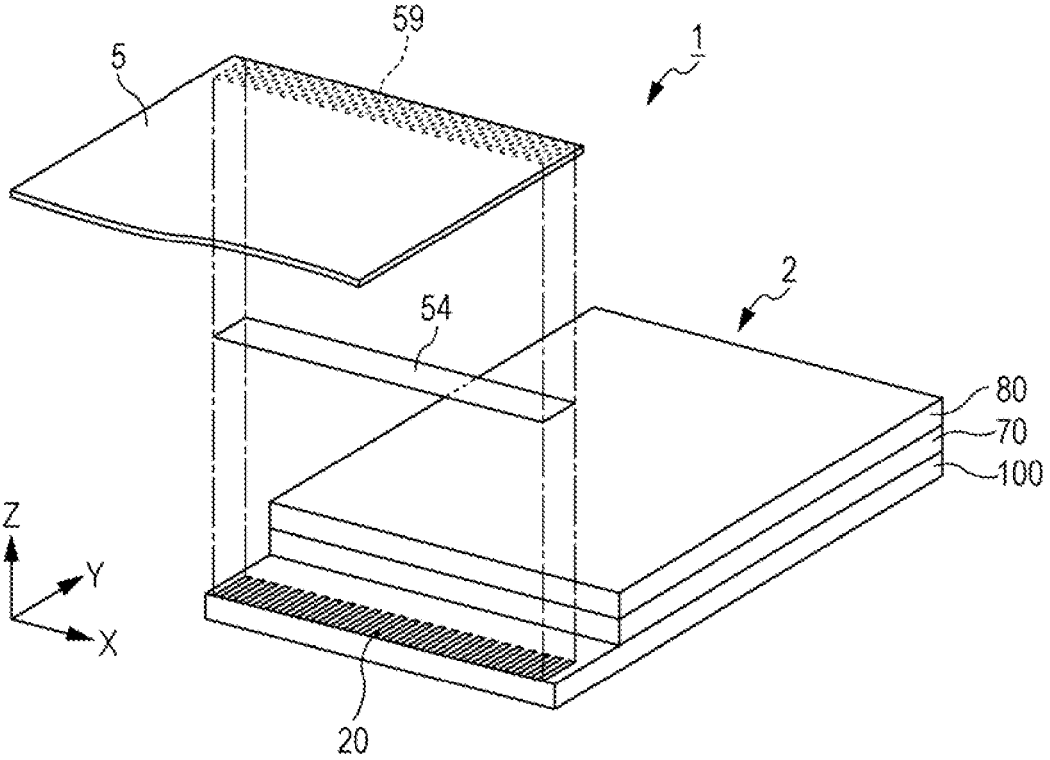
FIG. 1 is an exploded perspective view illustrating a configuration of an organic EL device according to a first embodiment.

As a first embodiment of an electro-optical device of the invention, a configuration of an organic EL device is described. FIG. 1 is an exploded perspective view illustrating a configuration of an organic EL device 1 according to the first embodiment.

The organic EL device (electro-optical device) 1 in the embodiment has an organic EL panel 2 including an element substrate 100 and a sealing substrate 80, and a flexible wiring plate 5. The organic EL panel 2 includes the element substrate 100, the sealing substrate 80, and a seal material 70 for bonding the element substrate 100 and the sealing substrate 80.

The element substrate 100 is provided with a plurality of mounting terminals 20 that are external connection terminals and the flexible wiring plate 5 is provided with a plurality of connection terminals 59 on a substrate facing the element substrate 100. The plurality of mounting terminals 20 provided on the element substrate 100 and the plurality of connection terminals 59 provided in the flexible wiring plate 5 are electrically connected to each other by an anisotropic conductive film (hereinafter, referred to as ACF) 54. Moreover, in the organic EL device 1, electrical connection between the mounting terminal 20 and the connection terminal 59 is not limited to the ACF 54 and, for example, solder paste, silver paste, conductive bonding material, and the like may be used.

Figure 2:
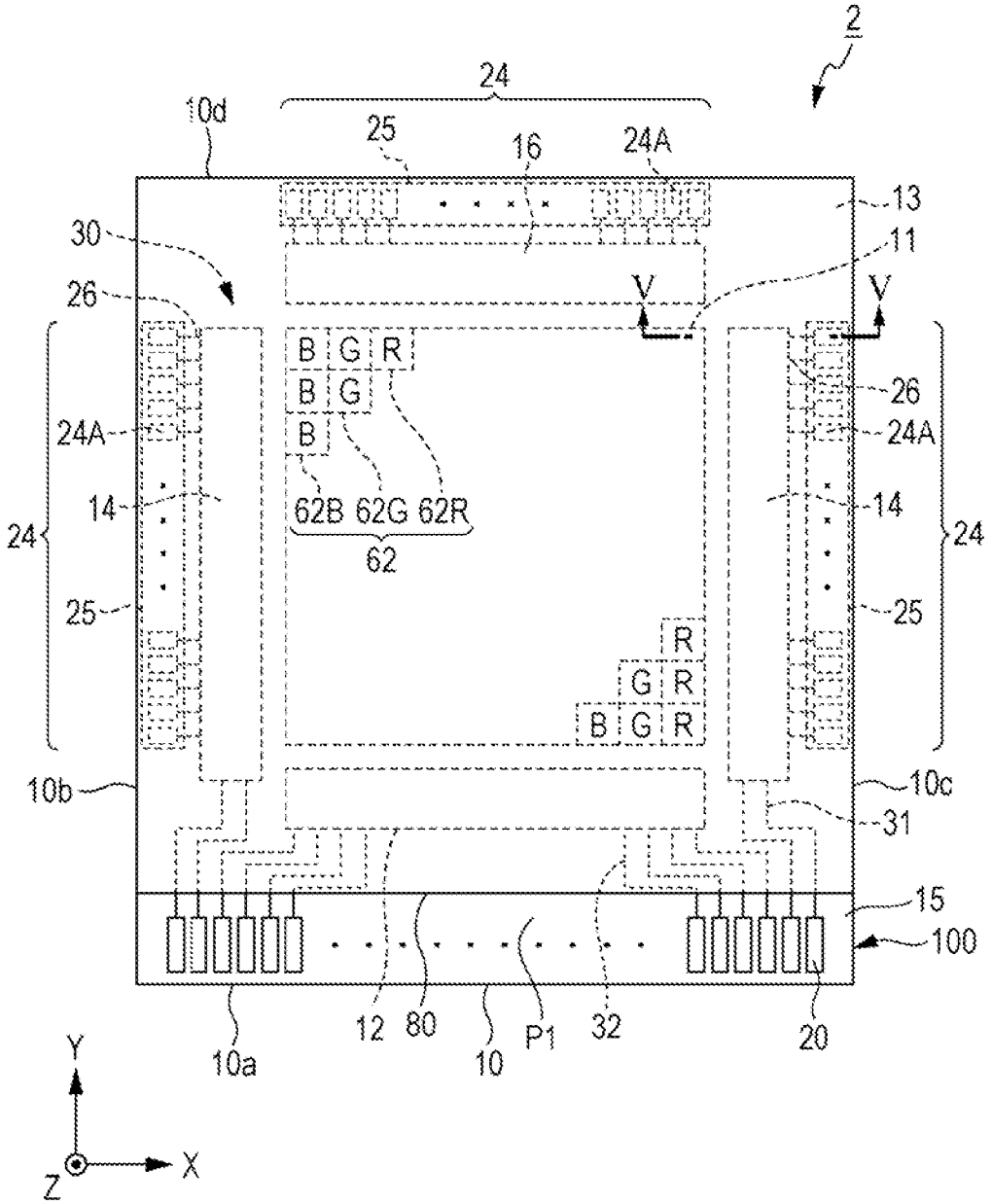
FIG. 2 is a plan view illustrating a schematic configuration of an organic EL panel according to the first embodiment.

FIG. 2 is a plan view illustrating a schematic configuration of the organic EL panel 2 in the first embodiment. Hereinafter, the schematic configuration of the organic EL panel 2 will be described with reference to FIG. 2.

As illustrated in FIG. 2, the organic EL panel 2 of the embodiment has a substrate 10 having a rectangular shape in a plan view. Specifically, the substrate 10 has a first side 10*a*, a second side 10*b* (side portion intersecting a −X axis direction) orthogonal to the first side 10*a*, a third side 10*c* (side portion intersecting a +X axis direction), and a fourth side 10*d* (side portion intersecting a +Y axis direction) parallel to the first side 10*a*. A first surface P1 of such a substrate 10 is provided with a display region (array region) 11, a peripheral region 13, and a mounting region 15.

Figure 3:
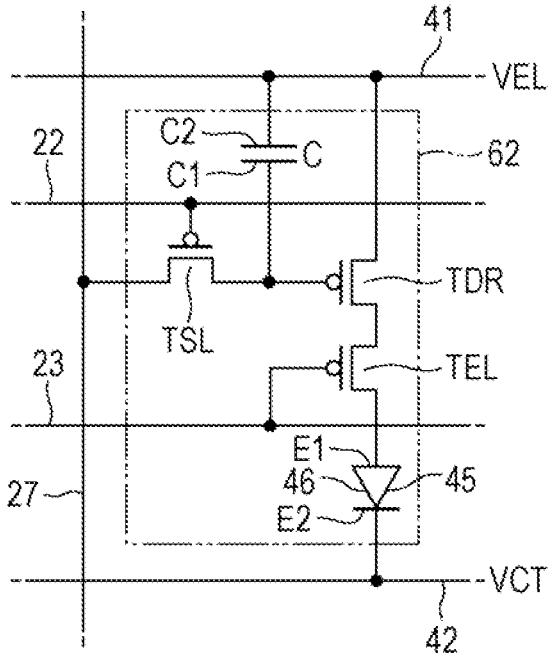
FIG. 3 is a circuit diagram of one light emitting pixel (pixel circuit) in a display region.

The display region 11 is a rectangular region in which a plurality of light emitting pixels 62 are arranged. A plurality of scanning lines (first drive lines) 22 (FIG. 3) extending in the X direction (row direction), a plurality of control lines 23 (FIG. 3) extending in the X direction corresponding to each scanning line 22 (FIG. 3), and a plurality of signal lines (second drive lines) 27 (FIG. 3) extending in the Y direction (column direction) intersecting the X direction (row direction) are formed in the display region 11. The light emitting pixel 62 is a region corresponding to intersection of each of the plurality of scanning lines 22 (FIG. 3) and each of the plurality of signal lines 27 (FIG. 3). Thus, the plurality of light emitting pixels 62 are arranged in a matrix form in the X direction and the Y direction of the display region 11 on the first surface P1 of the substrate 10.

Figure 4:
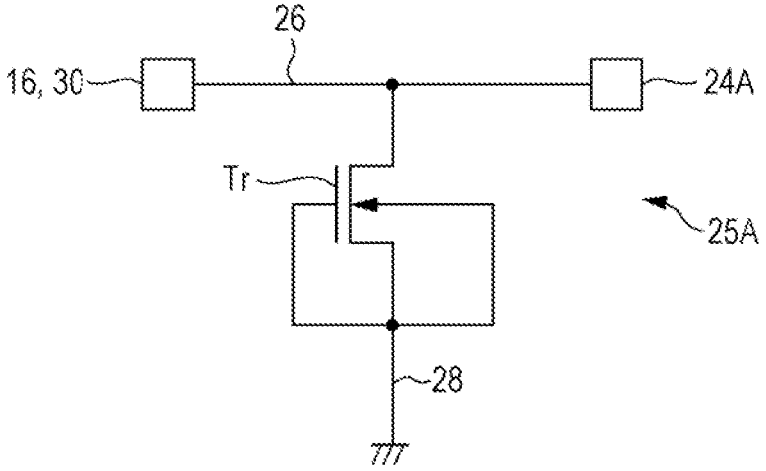
FIG. 4 is a circuit diagram of one electrostatic protection circuit in a peripheral region.

The peripheral region 13 is provided in a periphery of the substrate 10 and is a rectangular frame-shaped region surrounding the display region 11. The peripheral region 13 is provided with a drive circuit 30 including two scanning line drive circuits 14, a signal line drive circuit 12, an inspection circuit 16, an inspection terminal group 24, and an electrostatic protection circuit group 25. The inspection terminal group 24 has a plurality of inspection terminals 24A and the electrostatic protection circuit group 25 has a plurality of electrostatic protection circuits 25A (FIG. 4). The drive circuit 30 is a circuit for driving each light emitting pixel 62 in the display region 11.

The organic EL device 1 is a circuit built-in type display device configured of an active element such as a transistor in which the drive circuit 30 is directly formed on a surface of the substrate 10. Moreover, dummy pixels that do not directly contribute to image display may be formed in the peripheral region 13.

The electrostatic protection circuit groups 25 are provided in a plurality of inspection terminal groups 24 respectively connected to a pair of scanning line drive circuits 14 and the inspection circuit 16. Even though detailed description is given below, each of the plurality of electrostatic protection circuits 25A (FIG. 4) configuring the electrostatic protection circuit group 25 is connected to the inspection terminal 24A.

The mounting region 15 is provided in a region opposite (that is, outside the peripheral region 13) to the display region 11 across the peripheral region 13. The plurality of mounting terminals 20 for electrical connection with an external circuit are arranged in the mounting region 15. A control signal or a power supply potential is supplied from various external circuits (not illustrated) such as a control circuit or a power supply circuit to each mounting terminal 20. For example, the external circuit is mounted on the flexible wiring plate 5 (FIG. 1) having flexibility bonded to the mounting region 15.

A plurality of light emitting pixels 62 are arranged two-dimensionally in the display region (array region) 11 of the substrate 10. There are light emitting pixels 62B in which light emission of blue (B) is obtained, light emitting pixels 62G in which light emission of green (G) is obtained, and light emitting pixels 62R in which light emission of red (R) is obtained. Furthermore, the light emitting pixels 62 in which light emission of the same color is obtained are arranged in a vertical direction (Y axis direction) in the drawing and the light emitting pixels 62 in which light emission of different colors is obtained are arranged repeatedly in order of B, G, and R in a horizontal direction (X axis direction) in the drawing. The arrangement of such light emitting pixels 62 is referred to as a strip method, but the embodiment is not limited thereto. For example, the arrangement of the light emitting pixels 62 in which the light emission of different colors is obtained in the horizontal direction (X axis direction) may not be an order of B, G, and R, and, for example, may be an order of R, G, and B.

The light emitting pixels 62B, 62G, and 62R function as sub-pixels and one pixel unit is configured by three light emitting pixels 62B, 62G, and 62R in which the light emission corresponding to B, G, and R is obtained in the image display. Moreover, the configuration of the pixel unit is not limited to the embodiment and light emitting pixels 62 in which light emission of a color (including white) other than B, G, and R is obtained may be in the pixel unit. Moreover, the following description is given with the direction in which the light emitting pixels 62 of the different colors are arranged being referred to as the X axis direction and the direction in which the light emitting pixels 62 of the same color are arranged being referred to as the Y axis direction in the substrate 10.

The mounting terminals 20 are provided by being arranged along the first side 10*a* (side portion intersecting the −Y axis direction) of the substrate 10 having a rectangular shape in the X axis direction. The signal line drive circuit 12 and each of the scanning line drive circuits 14 controlling driving of the plurality of light emitting pixels 62 are electrically connected by wiring 31 and wiring 32.

The inspection terminals 24A are disposed on sides different from the first side 10*a* on which the mounting terminal 20 is disposed. Specifically, the inspection terminals 24A are provided by being respectively arranged along the second side 10*b*, the third side 10*c*, and the fourth side 10*d* in the Y axis direction and the X axis direction. The inspection terminal 24A is provided between the display region 11 of the light emitting pixels 62 and an outer edge portion of the substrate 10, and is electrically connected to each of the scanning line drive circuit 14 and the inspection circuit 16 by a wiring 26.

The signal line drive circuit 12 is disposed between the mounting terminal 20 and the display region 11 in the Y axis direction and extends along the first side 10*a* of the substrate 10 in the X axis direction.

A pair of scanning line drive circuits 14 are provided so as to face each other across the display region 11 of the light emitting pixels 62 in the X axis direction and are disposed between the second side 10*b*, the third side 10*c*, and the display region 11 of the light emitting pixels 62, and respectively extend along the second side 10*b* and the third side 10*c* in the Y axis direction.

The inspection circuit 16 is disposed between the inspection terminal 24A and the display region 11 of the light emitting pixels 62 in the Y axis direction and extends along the fourth side 10*d* in the X axis direction.

The electrostatic protection circuit groups 25 are on the edge side of the substrate 10 more than each of the scanning line drive circuits 14 and the inspection circuit 16 and are provided by being overlapped with the inspection terminal groups 24 (plurality of inspection terminals 24A) respectively connected to each of the scanning line drive circuits 14 and the inspection circuit 16 in a plan view.

The sealing substrate 80 is disposed facing the element substrate 100 so as to protect the light emitting pixels 62 and the like. As a material of the sealing substrate 80, a light-transparent glass substrate may be included.

In the embodiment, since the organic EL device 1 has a top emission structure, as the material of the substrate 10 configuring the element substrate 100, it is possible to use an opaque ceramic substrate or a semiconductor substrate in addition to the light-transparent glass substrate. As the semiconductor substrate, for example, a silicon substrate may be included.

As illustrated in FIG. 1, the element substrate 100 and the sealing substrate 80 are bonded through the seal material 70 having both adhesion and transparency. For example, for the seal material 70, it is possible to use a thermosetting or photocuring epoxy resin material and the like. After the seal material 70 is applied to the element substrate 100, the sealing substrate 80 is pressed against the element substrate 100 and the seal material 70 is expanded to a predetermined range and then the seal material 70 is cured.

FIG. 3 is a circuit diagram of one light emitting pixel (pixel circuit) 62 in the display region 11. Hereinafter, the circuit diagram of one light emitting pixel 62 will be described with reference to FIG. 3.

As illustrated in FIG. 3, the light emitting pixel 62 includes a light emitting element 45, a drive transistor TDR, a light emitting control transistor TEL, a selection transistor TSL, and a capacitive element C. Moreover, in the first embodiment, the transistors (TDR, TEL, and TSL) of the light emitting pixel 62 are configured of P-channel type transistors, but may be configured of N-channel type transistors.

The light emitting element 45 is an organic EL element (electro-optical device) in which an organic layer 46 including a light emitting layer of an organic EL material is interposed between a first pixel electrode (anode) E1 and a common electrode (cathode) E2. The first pixel electrode E1 is individually formed for each light emitting pixel 62 and the common electrode E2 is continuously formed over the plurality of light emitting pixels 62.

As illustrated in FIG. 3, the light emitting element 45 is disposed on a current path connecting a first power supply conductor 41 and a second power supply conductor 42. The first power supply conductor 41 is power supply wiring to which a power supply potential VEL on a high potential side is supplied. The second power supply conductor 42 is power supply wiring to which a power supply potential VCT on a low potential side is supplied.

The drive transistor TDR and the light emitting control transistor TEL are connected in series with respect to the light emitting element 45 on the current path connecting the first power supply conductor 41 and the second power supply conductor 42. Specifically, one (source region S) of a pair of current terminals of the drive transistor TDR is connected to the first power supply conductor 41. The light emitting control transistor TEL functions as a switch for controlling a conductive state (conductive/non-conductive) between the other (drain region D) of the pair of current terminals of the drive transistor TDR and the first pixel electrode E1 of the light emitting element 45. The drive transistor TDR generates a drive current corresponding to an amount of a current depending on a voltage between a gate and a source of the drive transistor.

In a state where the light emitting control transistor TEL is controlled such that it is in an ON state, the drive current is supplied from the drive transistor TDR to the light emitting element 45 through the light emitting control transistor TEL. At this time, the light emitting element 45 emits light with a brightness depending on the amount of the current of the drive current. In a state where the light emitting control transistor TEL is controlled to be an OFF state, the supply of the drive current to the light emitting element 45 is blocked. At this time, the light emitting element 45 is turned out. The gate of the light emitting control transistor TEL is connected to the control line 23.

The selection transistor TSL illustrated in FIG. 3 functions as a switch for controlling the conductive state (conductive/non-conductive) between the signal line 27 and the gate of the drive transistor TDR. The gate of the selection transistor TSL is connected to the scanning line 22. The capacitive element C is an electrostatic capacitor in which a dielectric body is interposed between a first capacitance electrode C1 and a second capacitance electrode C2. The first capacitance electrode C1 is connected to the gate of the drive transistor TDR. The second capacitance electrode C2 is connected to the first power supply conductor 41 (source of the drive transistor TDR). Thus, the capacitive element C holds the voltage between the gate and the source of the drive transistor TDR.

The signal line drive circuit 12 illustrated in FIG. 2 supplies the image signal supplied from the external circuit in parallel to the plurality of signal lines 27 in FIG. 3 in each writing period (horizontal scanning period) as a gradation potential (data signal) according to the gradation specified for each light emitting pixel 62. Meanwhile, the scanning line drive circuit 14 sequentially selects each of the plurality of scanning lines 22 in each writing period by supplying the scanning signal to each of the plurality of scanning lines 22. The selection transistor TSL of the light emitting pixel 62 corresponding to the scanning line 22 that is selected by the scanning line drive circuit 14 transits to the ON state. At this time, the gradation potential is supplied to the gate of the drive transistor TDR of each light emitting pixel 62 through the signal line 27 and the selection transistor TSL, and the voltage according to the gradation potential is held in the capacitive element C.

Meanwhile, when completing the selection of the scanning line 22 in the writing period, the scanning line drive circuit 14 controls the light emitting control transistor TEL of the light emitting pixel 62 corresponding to the control line 23 to be the ON state by supplying the control signal to each control line 23. Thus, the drive current according to the voltage held in the capacitive element C in the immediately preceding writing period is supplied from the drive transistor TDR to the light emitting element 45 through the light emitting control transistor TEL. As described above, the light emitting element 45 emits the light with the brightness according to the gradation potential and thereby an arbitrary image specified by the image signal is displayed in the display region 11.

FIG. 4 is a circuit diagram of one electrostatic protection circuit 25A in the peripheral region 13. Hereinafter, the circuit diagram of the electrostatic protection circuit 25A will be described with reference to FIG. 4.

As illustrated in FIG. 4, the electrostatic protection circuit 25A allows a surge current caused by the static electricity and the like to flow to common wiring and is provided between the drive circuit 30, the inspection circuit 16, and each inspection terminal 24A. The electrostatic protection circuit 25A has a transistor Tr connected to a diode, the source of the transistor Tr is connected to the inspection terminal 24A, and the gate and the drain are connected to a low potential line (substrate potential) 28.

Figure 5:
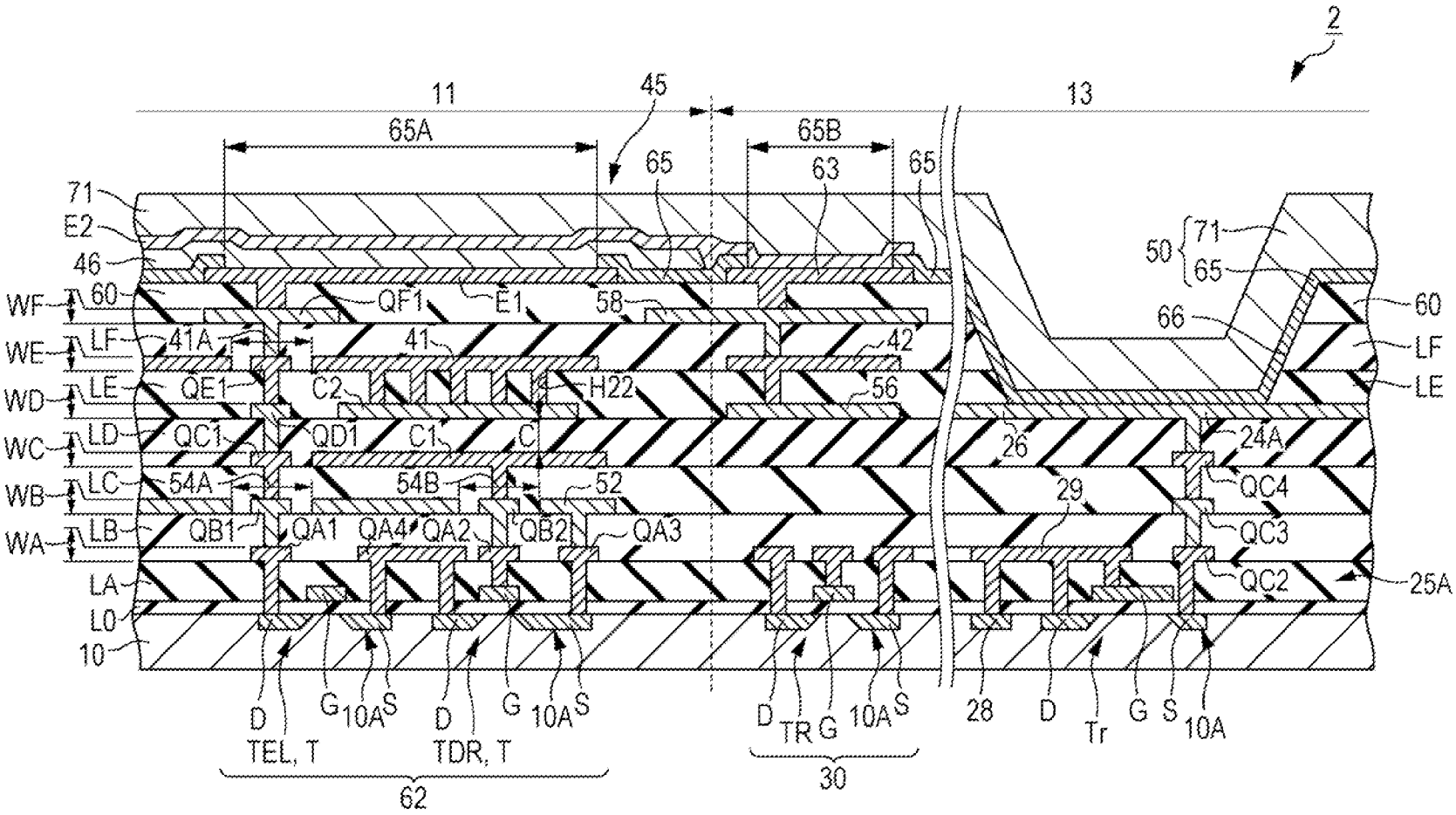
FIG. 5 is a cross-sectional view taken along a line V-V in FIG. 2 and a view illustrating a structure of a part of the organic EL panel in detail.

FIG. 5 is a cross-sectional view taken along line V-V in FIG. 2 and a view illustrating a structure of a part of the organic EL panel 2 in detail. Moreover, illustration of the selection transistor TSL and the mounting terminal 20, illustration of specific wiring related to the selection transistor TSL and the mounting terminal 20, and the like are omitted for the sake of convenience.

As illustrated in FIG. 5, the transistor T (TDR, TEL, and TSL (not illustrated in FIG. 5)) of the light emitting pixel 62 is formed in the display region 11 on the surface of the substrate 10 formed of a semiconductor material such as silicon. A transistor TR of the drive circuit 30, the transistor Tr of the electrostatic protection circuit 25A, and the low potential line 28 connected to the transistor Tr are formed in the peripheral region 13.

The transistors T, TR, and Tr are configured by including an active region 10A (source region S/drain region D) formed on the surface of the substrate 10, an insulation film L0 (gate insulation film) covering the surface of the substrate 10, and a gate G formed on the insulation film L0. The active region 10A is configured of an ion implantation region into which impurity ions are implanted in the substrate 10. A channel region of the transistor T (TDR, TEL, and TSL (not illustrated in FIG. 5)) of the light emitting pixel 62 exists between the source region S and the drain region D. Another kind of ion that is different from the ions implanted into the active region 10A is implanted into the channel region, but illustration thereof is omitted. The gate G of each of the transistors T, TR, and Tr is disposed in a position facing the channel region across the insulation film L0.

As illustrated in FIG. 5, a multilayered wiring layer in which a plurality of insulating layers (LA to LE) and a plurality of wiring layers (WA to WF) are alternately laminated is formed on the insulation film L0 in which the gate G of each transistor T is formed. For example, each insulating layer is formed of an inorganic insulating material such as a silicon compound (typically, silicon nitride or silicon oxide). Each wiring layer W is formed of a conductive material having a low resistance containing aluminum, silver, or the like. In the following description, a relationship in which a plurality of elements are collectively formed in the same process by selectively removing the conductive layer (single layer or plural layers) is represented as "formed from the same layer".

An insulating layer LA in FIG. 5 is formed on the surface of the insulation film L0 in which the gate G of each of the transistors T, TR, and Tr is formed. A conductor pattern including a plurality of relay electrodes QA (QA1 to QA4) and a connection section 29 is formed from the same layer (wiring layer WA) on the surface of the insulating layer LA. The relay electrode QA1 is electrically connected to the active region 10A (drain region D) of the light emitting control transistor TEL through a conduction hole (contact hole) passing through the insulating layer LA and the insulation film L0. The relay electrode QA2 is electrically connected to the gate G of the drive transistor TDR through the conduction hole passing through the insulating layer LA.

The relay electrode QA3 is electrically connected to the active region 10A (source region S) of the drive transistor TDR through the conduction hole passing through the insulating layer LA and the insulation film L0. The relay electrode QA4 is electrically connected to the active region 10A (source region S) of the light emitting control transistor TEL and the active region 10A (drain region D) of the drive transistor TDR through each conduction hole passing through the insulating layer LA and the insulation film L0. That is, as illustrated in FIG. 3, the drive transistor TDR and the light emitting control transistor TEL are connected in series.

Furthermore, the connection section 29 is electrically connected to the gate G of the transistor Tr of the electrostatic protection circuit 25A through the conduction hole passing through the insulating layer LA, and is electrically connected to the drain region D and the low potential line 28 of transistor through the conduction hole passing through the insulation film L0 and the insulating layer LA. That is, the gate G, the drain region D, and the low potential line 28 of transistor are electrically connected through the connection section 29.

An insulating layer LB in FIG. 5 is formed on the surface of the insulating layer LA in which the wiring layer WA is formed. A conductor pattern including a connection conductor 52 and a plurality of relay electrodes QB (QB1 and QB2) are formed from the same layer (wiring layer WB) on the surface of the insulating layer LB. The connection conductor 52 is electrically connected to the relay electrode QA3 of the wiring layer WA through the conduction hole passing through the insulating layer LB. That is, the connection conductor 52 is electrically connected to the active region 10A (source region S) of the drive transistor TDR.

As illustrated in FIG. 5, an insulating layer LC is formed on the surface of the insulating layer LB in which the wiring layer WB is formed. A conductor pattern including the first capacitance electrode C1 and a plurality of relay electrodes QC (QC1 to QC4) of the capacitive element C are formed from the same layer (wiring layer WC) on the surface of the insulating layer LC. The first capacitance electrode C1 is electrically connected to the relay electrode QB2 of the wiring layer WB through the conduction hole passing through the insulating layer LC. That is, the first capacitance electrode C1 of the capacitive element C is electrically connected to the gate G of the drive transistor TDR through the relay electrode QB2 and the relay electrode QA2. The relay electrode QC1 is electrically connected to the relay electrode QB1 through the conduction hole passing through the insulating layer LC. The relay electrode QC4 is formed in the peripheral region 13 and is electrically connected to the source region S of the transistor Tr of the electrostatic protection circuit 25A through the relay electrode QC3 and the relay electrode QC2.

An insulating layer LD in FIG. 5 is formed on the surface of the insulating layer LC in which the wiring layer WC is formed. A conductor pattern including the second capacitance electrode C2 of the capacitive element C, a relay electrode QD1, a conduction section 56, and the inspection terminal 24A are formed from the same layer (wiring layer WD) on the surface of the insulating layer LD.

The second capacitance electrode C2 is formed in a shape and in a position overlapping the first capacitance electrode C1 in a plan view. Thus, the capacitive element C having a structure in which the first capacitance electrode C1 and the second capacitance electrode C2 are provided across the insulating layer LD is formed for each light emitting pixel 62.

The relay electrode QD1 is electrically connected to the relay electrode QC1 of the wiring layer WC through the conduction hole passing through the insulating layer LD.

The inspection terminal 24A is formed in the peripheral region 13 and is electrically connected to the relay electrode QC4 of the wiring layer WC through the conduction hole passing through the insulating layer LD. That is, the inspection terminal 24A is electrically connected to the source region S of the transistor Tr of the electrostatic protection circuit 25A through the relay electrode QC4, the relay electrode QC3, and the relay electrode QC2. The electrostatic protection circuit 25A is formed in the layer lower than that of the inspection terminal 24A and a plurality of insulating layers (LB, LC, and LD) exist between the electrostatic protection circuit 25A and the inspection terminal 24A.

An insulating layer LE in FIG. 5 is formed on the surface of the insulating layer LD in which the wiring layer WD is formed. A conductor pattern including the first power supply conductor 41 and the second power supply conductor 42 is formed from the same layer (wiring layer WE) on the surface of the insulating layer LE. The wiring layer WE is formed of a light reflecting conductive material containing aluminum, silver, or the like.

A relay electrode QE1 is electrically connected to the relay electrode QD1 of the wiring layer WD through the conduction hole passing through the insulating layer LE. The mounting terminal 20 (FIG. 2) for supplying the power supply potential is electrically connected to the connection conductor 52.

The first power supply conductor 41 is formed in a solid rectangular pattern over a substantially entire display region 11 in a plan view. For example, the first power supply conductor 41 is formed of a light reflecting conductive material containing aluminum, silver, or the like. Specifically, the first power supply conductor 41 may be a single material such as aluminum or silver, and may be configured of a laminated film of titanium (Ti)/aluminum-copper alloy (AlCu) and the like. However, the first power supply conductor 41 is not provided in a region between adjacent pixel regions.

The first power supply conductor 41 is electrically connected to the second capacitance electrode C2 of the wiring layer WD through a plurality of conduction holes H22 passing through the insulating layer LE. A plurality (five) of conduction holes H22 arranged in the Y direction are formed for each light emitting pixel 62. The first power supply conductor 41 is electrically connected to the connection conductor 52 of the wiring layer WB through a plurality of conduction holes passing through insulating layers L (LE, LD, and LC) positioned between layers of the first power supply conductor 41 and the connection conductor 52.

As illustrated in FIG. 5, the first power supply conductor 41 is electrically connected to the active region 10A (source region S) of the drive transistor TDR through the connection conductor 52 and the relay electrode QA3, and is electrically connected to the mounting terminal 20 (FIG. 2) for supplying the power supply potential through the connection conductor 52 and the like.

The second power supply conductor 42 is electrically connected to the conduction section 56 of the wiring layer WD through the conduction hole passing through the insulating layer LE. That is, the power supply potential on the low potential side supplied to the mounting terminal 20 (FIG. 2) is supplied to the second power supply conductor 42 through the conduction section 56.

A first optical adjustment layer LF in FIG. 5 is formed on the surface of the insulating layer LE in which the wiring layer WE is formed. A conductor pattern including a relay electrode QF1 and a protective conductive layer 58 is formed from the same layer (wiring layer WF) on the surface of the first optical adjustment layer LF. For example, the wiring layer WF is formed of a light shielding conductive material (for example, titanium nitride).

The relay electrode QF1 is electrically connected to the relay electrode QE1 through the conduction hole passing through the first optical adjustment layer LF. As illustrated in FIG. 5, the relay electrode QF1 is formed so as to overlap an opening section 41A of the first power supply conductor 41 in a plan view. That is, the outer periphery of the relay electrode QF1 is positioned outside the inner periphery of the opening section 41A in a plan view. Since the relay electrode QF1 is formed of the light shielding conductive material, penetration of external light from the opening section 41A to the multilayered wiring layer is blocked by the relay electrode QF1. Thus, an advantage of reducing or preventing leakage of the current of each transistor T due to light irradiation is provided.

The protective conductive layer 58 in FIG. 5 is electrically connected to the second power supply conductor 42 through the conduction hole passing through the first optical adjustment layer LF.

As illustrated in FIG. 5, a second optical adjustment layer 60 is formed on the surface of the first optical adjustment layer LF in which the wiring layer WF is formed. The first optical adjustment layer LF and the second optical adjustment layer 60 are light transparent film bodes defining a resonance wavelength of the resonator structure (detailed description is given below) of each light emitting pixel 62. Specifically, the first optical adjustment layer LF and the second optical adjustment layer 60 are formed of a light transparent insulation material such as silicon compound (typically, silicon nitride or silicon oxide).

As illustrated in FIG. 5, the first pixel electrode E1, a conduction electrode 63 in the peripheral region 13, and the plurality of mounting terminals 20 (FIG. 2) in the mounting region 15 are formed from the same layer on the surface of the second optical adjustment layer 60 for each light emitting pixel 62 in the display region 11. For example, the first pixel electrode E1, the conduction electrode 63, and the mounting terminal 20 (FIG. 2) are formed of a light transparent conductive material such as indium tin oxide (ITO).

The first pixel electrode E1 is a substantially rectangular electrode (pixel electrode) functioning as the anode of the light emitting element 45. The first pixel electrode E1 is electrically connected to the relay electrode QF1 through the conduction hole passing through the second optical adjustment layer 60. That is, the first pixel electrode E1 is electrically connected to the active region 10A (drain region D) of the light emitting control transistor TEL through each of the relay electrodes (QF1, QE1, QD1, QC1, QB1, and QA1) of the multilayered wiring layer. Each of the relay electrodes (QF1, QE1, QD1, QC1, QB1, and QA1) of the multilayered wiring layer is provided for electrically connecting the first pixel electrode E1 and the transistor (light emitting control transistor TEL in the illustration of the first embodiment). Meanwhile, the conduction electrode 63 in the peripheral region 13 is electrically connected to the protective conductive layer 58 through the conduction hole passing through the second optical adjustment layer 60.

Each mounting terminal 20 in the mounting region 15 illustrated in FIG. 2 is appropriately electrically connected to the wiring in the multilayered wiring layer. For example, the mounting terminal 20 (FIG. 2) to which the power supply potential on the high potential side is supplied is electrically connected to the connection conductor 52 through each relay electrode of the multilayered wiring layer. Thus, the power supply potential of the high potential supplied to the mounting terminal 20 (FIG. 2) is supplied to the first power supply conductor 41 through each relay electrode and the connection conductor 52. The mounting terminal 20 to which the power supply potential on the low potential side is supplied is electrically connected to the second power supply conductor 42 through the conduction section 56 of the multilayered wiring layer. Thus, the power supply potential of the low potential is supplied to the second power supply conductor 42 through the conduction section 56 of the multilayered wiring layer.

A pixel separation layer 65 formed over an entire display region 11 is formed on the surface of the second optical adjustment layer 60 in which the first pixel electrode E1, the conduction electrode 63, and the mounting terminal 20 (FIG. 2) are formed.

For example, the pixel separation layer 65 is formed of an inorganic material of the insulating layer such as a silicon compound (typically, silicon nitride or silicon oxide). An opening section 65A corresponding to the first pixel electrode E1 in the display region 11 and an opening section (not illustrated in FIG. 5) corresponding to each mounting terminal 20 (FIG. 2) in the mounting region 15 are formed in the pixel separation layer 65. The mounting terminal 20 (FIG. 2) is electrically connected to the external circuit through the opening section (not illustrated in FIG. 5).

The pixel separation layer 65 according to the embodiment is formed so as to cover the surface of the plurality of inspection terminals 24A provided in the peripheral region 13. Specifically, the pixel separation layer 65 is formed along an internal surface of an opening section 66 formed by passing through the second optical adjustment layer 60, the first optical adjustment layer LF, and the insulating layer LE on the plurality of inspection terminals 24A. The surface of each inspection terminal 24A exposed from the opening section 66 is covered by the pixel separation layer 65.

The organic layer 46 is partially formed on the surface of the second optical adjustment layer 60 in which the pixel separation layer 65 is formed. The organic layer 46 is continuously provided over the plurality of light emitting pixels 62 formed in the display region 11. The organic layer 46 is configured by including a light emitting layer formed of an organic EL material.

Even though not illustrated in FIG. 5, the organic layer 46 includes a positive hole injection layer, a light emitting layer, and an electron injection layer. The organic layer 46 emits white light by supplying the current. The white light is light having a spectrum over a wavelength range of blue, a wavelength range of green, and a wavelength range of red, and has at least two peaks in a wavelength range of visible light.

The common electrode E2 is formed on the surface of the second optical adjustment layer 60 in which the organic layer 46 is formed over both the display region 11 and the peripheral region 13. The common electrode E2 functions as a cathode of the light emitting element 45. In the organic layer 46, a region sandwiched between the first pixel electrode E1 and the common electrode E2 inside of the opening section 65A of the pixel separation layer 65 emits light as a light emitting region. That is, a portion in which the first pixel electrode E1, the organic layer 46, and the common electrode E2 are laminated inside the opening section 65A functions as the light emitting element 45.

The common electrode E2 functions as a semi-transmissive reflective layer having properties (semi-transmissive reflective properties) in which a part of light reaching the surface is transmitted and the rest thereof is reflected. The common electrode E2 having the semi-transmissive reflective properties can be realized by, for example, forming a conductive material having light reflectivity such as an alloy containing silver or magnesium with a thin film thickness. The light emitted from the organic layer 46 travels back and forth between the first power supply conductor 41 and the common electrode E2 and is selectively amplified with components of specific resonance wavelength, and is transmitted through the common electrode E2, and then is emitted to an observation side (opposite to the substrate 10). That is, a resonator structure for causing resonation in the light emitted from the organic layer 46 is formed between the first power supply conductor 41 that functions as the reflective layer and the common electrode E2 that functions as the semi-transmissive reflective layer.

The first optical adjustment layer LF and the second optical adjustment layer 60 are elements for individually setting the resonance wavelength (display color) of the resonator structure for each display color of the light emitting pixel 62. Specifically, an optical path length (optical distance) between the first power supply conductor 41 and the common electrode E2 configuring the resonator structure is appropriately adjusted depending on the film thickness of the first optical adjustment layer LF and the second optical adjustment layer 60 and thereby the resonance wavelength of the light emitted from each light emitting pixel 62 is set for each display color.

A sealing layer (sealing film) 71 is formed on the surface of the common electrode E2 over the display region 11 and the peripheral region 13. The sealing layer 71 is a film body that reduces or prevents penetration of outside air or moisture by sealing each configuration element formed on the substrate 10, and has light transmissivity.

The sealing layer 71 is formed by a single layer or plural layers formed of an inorganic material or an organic material. The sealing layer 71 is not formed in the mounting region 15 illustrated in FIG. 2 and each mounting terminal 20 is exposed in the mounting region 15.

A multilayered sealing film 50 configured of the pixel separation layer 65 and the sealing layer 71 in the peripheral region 13 is formed on the inspection terminal 24A in the embodiment. The inspection terminal 24A is not exposed to the outside because the surface thereof is covered by the multilayered sealing film 50.

Figure 6:
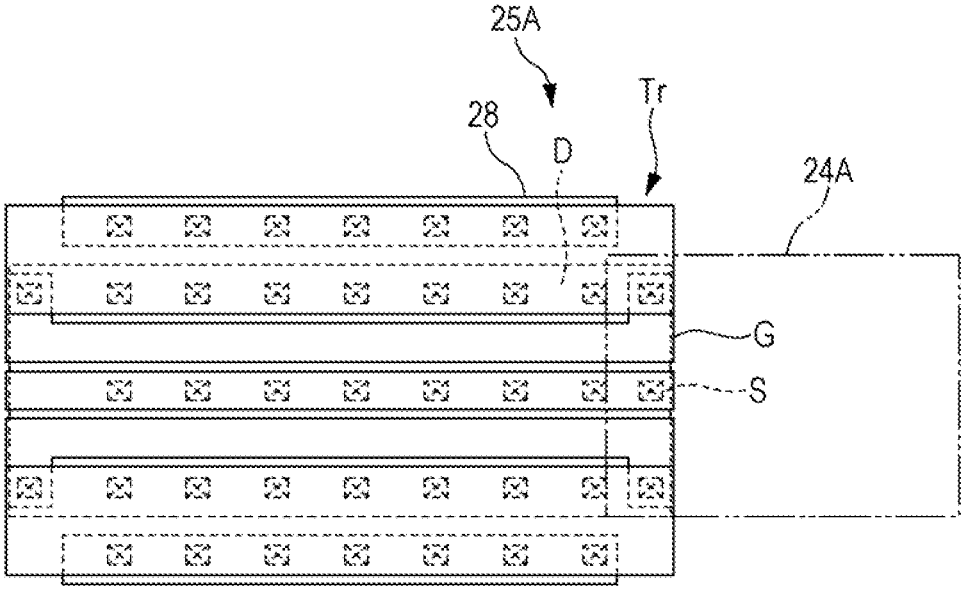
FIG. 6 is a view illustrating arrangement of the electrostatic protection circuit and the inspection terminal in a plan view.

FIG. 6 is a view illustrating an arrangement of the electrostatic protection circuit 25A and the inspection terminal 24A in a plan view.

As illustrated in FIG. 6, the electrostatic protection circuit 25A has a shape having an area larger than an area of the inspection terminal 24A in a plan view. In the embodiment, at least a part of the electrostatic protection circuit 25A overlaps the inspection terminal 24A in a plan view. In FIG. 6, the electrostatic protection circuit 25A and the inspection terminal 24A are disposed such that peripheries thereof overlap each other, but an entirety of the inspection terminal 24A may overlap the electrostatic protection circuit 25A in a plan view.

The gate of the transistor configuring the electrostatic protection circuit 25A may overlap the inspection terminal 24A in a plan view and the active region or the semiconductor film of the transistor configuring the electrostatic protection circuit 25A may overlap the inspection terminal 24A in a plan view. Furthermore, the drain region D or the source region S of the transistor configuring the electrostatic protection circuit 25A, or the wiring connected to the drain region D or the source region S may overlap the inspection terminal 24A in a plan view. Furthermore, the low potential line 28 may overlap the inspection terminal 24A in a plan view.

In the organic EL device 1, inspection for electrical characteristics of the light emitting element 45, the drive circuit 30, or the like is performed by using the inspection terminal 24A. Such inspection is performed before forming the multilayered sealing film 50 and is performed by bringing an inspection probe into contact with the surface of the inspection terminal 24A exposed from the opening section 66. The surface of each inspection terminal 24A exposed for the inspection is covered and sealed by the multilayered sealing film 50 by forming the multilayered sealing film 50 on the drive circuit 30 (pair of scanning line drive circuits 14 and the inspection circuit 16) after completing the inspection. Thus, static electricity is prevented from penetrating from the inspection terminal 24A and it is possible to reduce or prevent the electrostatic breakdown of the drive circuit 30 and the like.

When inspection of electrical characteristics of the light emitting element 45, the drive circuit 30, or the like is performed by using the inspection terminal 24A, the film thickness is not uniform and defects may occur when forming the multilayered sealing film 50 after the inspection due to irregularities of scratches on the surface of the inspection terminal 24A that occur when bringing the probe into contact with the inspection terminal 24A. If defects and the like occur in the multilayered sealing film 50, there is a concern that static electricity may flow into the inspection terminal 24A thereby causing the electrostatic breakdown of the light emitting element 45 or the drive circuit 30.

Thus, the organic EL device 1 of the embodiment includes the electrostatic protection circuit 25A between the inspection terminal 24A and the drive circuit 30. The transistor Tr included in the electrostatic protection circuit 25A is one in which the diode is connected between the gate and the drain, and the substrate potential is applied to the drain. Thus, the electrostatic protection circuit 25A can release the charge by the static electricity without breaking down electronic components on the substrate 10 such as the light emitting element 45, the drive circuit 30, and the inspection circuit 16 even if the charge is injected into the inspection terminal 24A by the static electricity.

Since the inspection of the characteristics using the inspection terminal 24A is performed by bringing the probe into contact with the inspection terminal 24A, there is a concern about the breakdown of the electrostatic protection circuit 25A due to the stress when bringing the probe into contact. In consideration of this, when providing the inspection terminal 24A and the electrostatic protection circuit 25A on the same substrate, the inspection terminal 24A and the electrostatic protection circuit 25A are usually disposed so as not to overlap each other in a plan view. However, in the configuration simultaneously including the inspection terminal 24A and the electrostatic protection circuit 25A, it is difficult to reduce the size of the device.

Thus, in the embodiment, the inspection terminal 24A and the electrostatic protection circuit 25A are disposed on the substrate 10 such that some parts thereof overlap each other in a plan view. Therefore, it is possible to further reduce the size of the device than in the case where the inspection terminal 24A and the electrostatic protection circuit 25A are disposed so as not to overlap each other in a plan view. Specifically, it is possible to prevent the area of the peripheral region 13 from being increased. Furthermore, in the configuration of the embodiment, as illustrated in FIG. 6, a main portion (portion other than overlapping region) of the inspection terminal 24A does not overlap the electrostatic protection circuit 25A in a plan view, the stress when bringing the probe into contact is unlikely to affect to the electrostatic protection circuit 25A of the lower layer.

Furthermore, an overlapping amount between the inspection terminal 24A and the electrostatic protection circuit 25A in a plan view can be adjusted anyway. Thus, even if the structure of the electrostatic protection circuit 25A is large in a plan view to increase the performance, it is possible to prevent the size of the device from being increased if the entirety of the inspection terminal 24A is disposed to overlap the electrostatic protection circuit 25A. Furthermore, in the embodiment, since a plurality of insulating layers L (LB, LC, and LD) are formed between the electrostatic protection circuit 25A and the inspection terminal 24A, even if the overlapping region between the inspection terminal 24A and the electrostatic protection circuit 25A in a plan view is increased, the stress when bringing the probe into contact is unlikely to affect the electrostatic protection circuit 25A. Thus, it is possible to eliminate the concern of the breakdown of the electrostatic protection circuit 25A regardless of a degree of overlapping between the inspection terminal 24A and the electrostatic protection circuit 25A in a plan view.

Moreover, in the embodiment, the plurality of inspection terminals 24A are connected to the scanning line drive circuit 14 or the inspection circuit 16, but may be connected to the signal line drive circuit 12. Otherwise, the inspection terminal 24A is directly connected to the scanning line 22 or the signal line 27.

Second Embodiment

Figure 7:
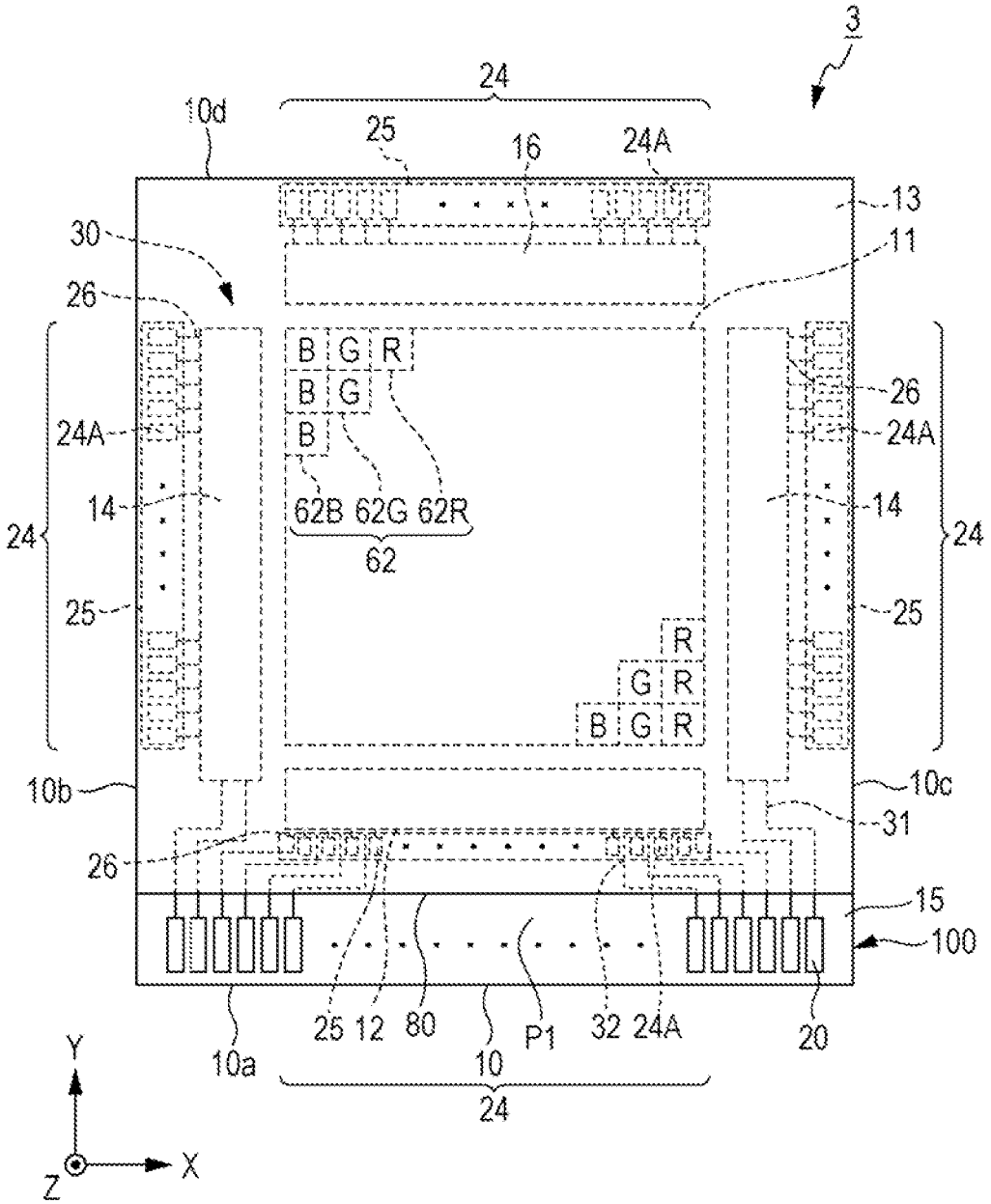
FIG. 7 is a plan view illustrating a schematic configuration of an organic EL device according to a second embodiment.

Next, an organic EL device in a second embodiment will be described. FIG. 7 is a plan view illustrating a schematic configuration of an organic EL device (electro-optical device) 3 in the second embodiment.

A basic configuration of the organic EL device 3 of the second embodiment is a top emission type organic EL device similar to the organic EL device of the first embodiment.

As illustrated in FIG. 7, the organic EL device 3 of the embodiment is configured such that a plurality of inspection terminals 24A are connected to a signal line drive circuit (drive circuit) 12 in addition to a pair of scanning line drive circuits 14 and the inspection circuit 16. Thus, it is possible to reduce or prevent the electrostatic breakdown of a light emitting pixel 62, the pair of scanning line drive circuits 14, the inspection circuit 16, or the signal line drive circuit 12.

Third Embodiment

Figure 8:
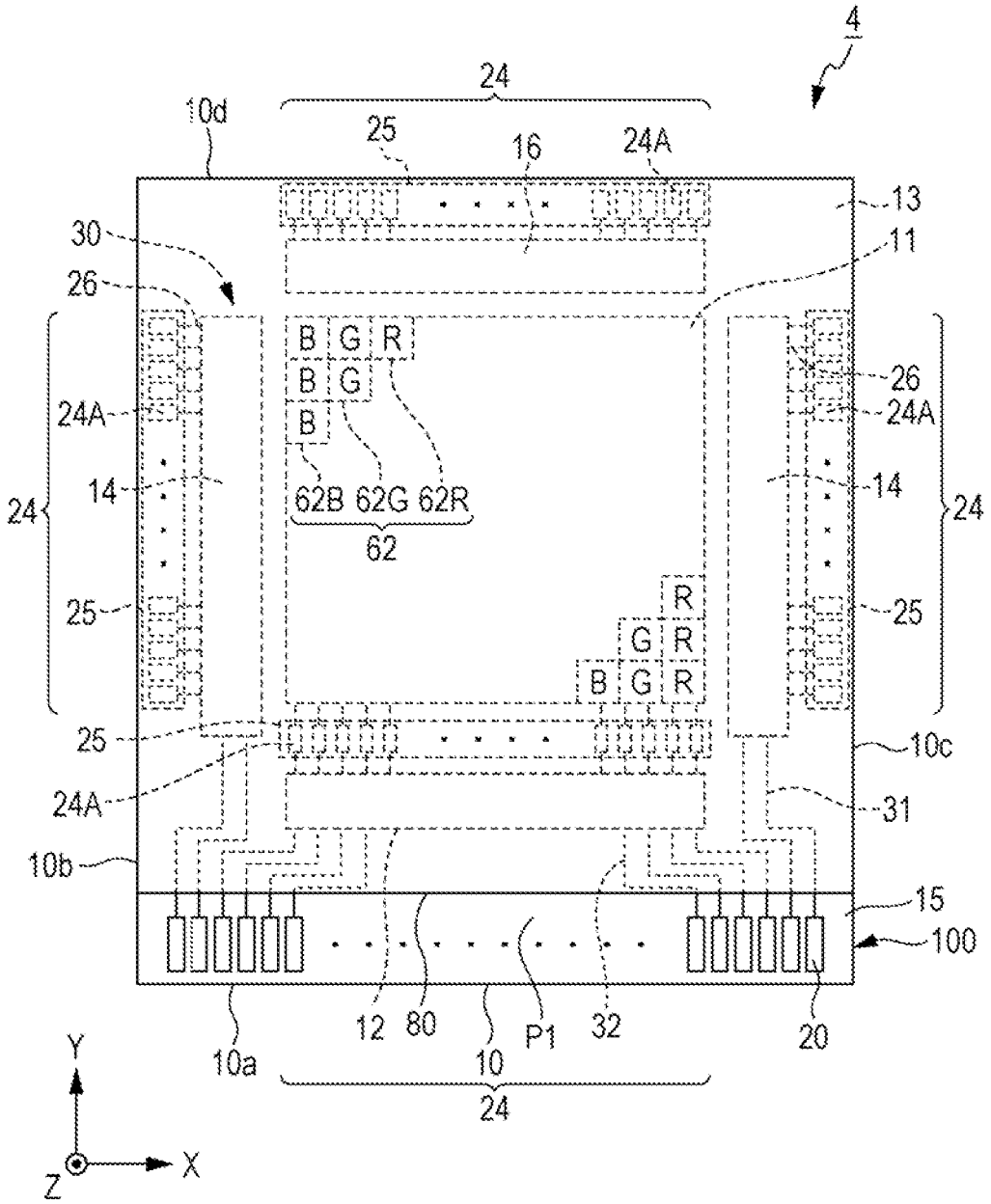
FIG. 8 is a plan view illustrating a schematic configuration of an organic EL device according to a third embodiment.

Next, an organic EL device in a third embodiment will be described. FIG. 8 is a plan view illustrating a schematic configuration of an organic EL device (electro-optical device) 4 in the third embodiment. A basic configuration of the organic EL device 4 of the third embodiment is a top emission type organic EL device similar to the organic EL device of the first embodiment.

As illustrated in FIG. 8, in the organic EL device 4 of the embodiment, an inspection terminal 24A is directly connected to each of a plurality of signal lines 27 (second drive line). It is possible to reliably reduce or prevent the electrostatic breakdown of a light emitting pixel 62 while increasing accuracy of the inspection of the electrical characteristics of a plurality of light emitting pixels 62 together with each inspection terminal group 24 on the side of a pair of scanning line drive circuits 14 by providing the inspection terminal group 24 also on the signal line 27 side.

Above, the mounting structure, the electro-optical device, and the electronic apparatus of the invention are described with reference to the illustrated embodiments, but the invention is not limited to the embodiments. The configuration of each section may be replaced by an arbitrary configuration having a similar function. Furthermore, another arbitrary configuration may be added to the invention. Furthermore, the configurations of each embodiment may be appropriately combined.

In the embodiments described above, the substrate 10 is formed of the semiconductor material such as silicon and the transistors T, TR, and Tr have the active region 10A (source region S/drain region D) formed on the surface of the substrate 10, but the substrate 10 may be an insulating substrate such as glass, and the active region of the transistors T, TR, and Tr may be configured of a semiconductor film provided on the insulating substrate.

Fourth Embodiment

Electronic Apparatus

Figure 9:
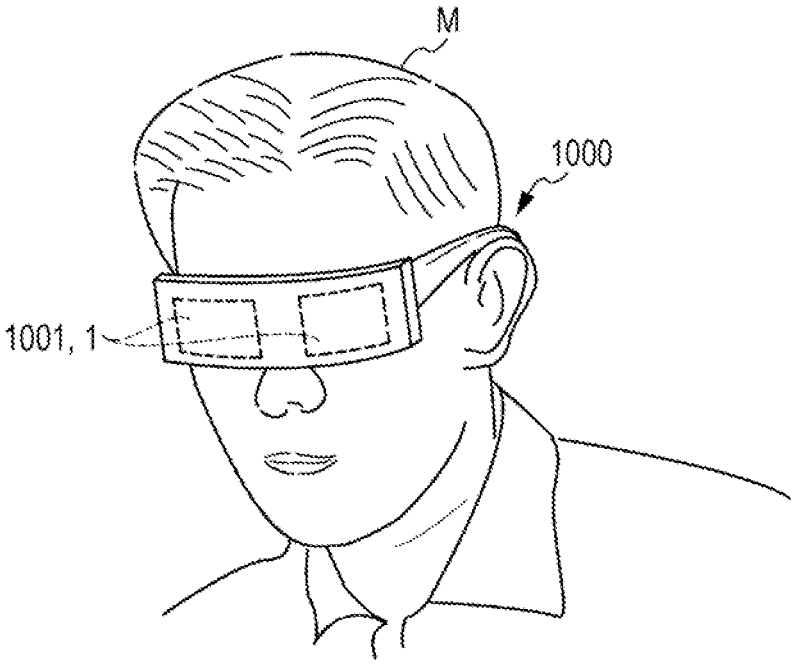
FIG. 9 is a schematic view illustrating a head-mounted display as an example of an electronic apparatus.

The electronic apparatus according to an embodiment of the invention will be described with reference to FIG. 9. FIG. 9 is a schematic view illustrating a head-mounted display as one example of the electronic apparatus.

As illustrated in FIG. 9, a head-mounted display (HMD) 1000 as the electronic apparatus of the embodiment has two display sections 1001 provided corresponding to the left and right eyes. An observer M can see characters, images, or the like displayed on the display sections 1001 by mounting the head-mounted display 1000 on the head as spectacles. For example, if the images are displayed on the left and right display sections 1001, considering parallax, it is possible to enjoy watching stereoscopic video.

The organic EL device of the embodiment described above that is a self-luminous display device is mounted on the display sections 1001. Therefore, it is possible to provide the head-mounted display 1000 that is lightweight with high reliability in the quality of the light emitting function.

The head-mounted display 1000 is not limited to the configuration in which the observer M directly sees the display contents of the display sections 1001 and may be configured to indirectly see the display contents by a mirror and the like. Furthermore, the head-mounted display 1000 is not limited to the configuration having two display sections 1001 and may be configured to include one display section 1001 corresponding to one of the left and right eyes.

Moreover, the electronic apparatus on which the organic EL device 1 described above is mounted is not limited to the head-mounted display 1000. For example, an electronic apparatus having a display section such as a head-up display, an electronic view finder (EVF) of a digital camera, a portable information terminal, and a navigator is included. Furthermore, the invention is not limited to the display section and may be applied to a lighting device or an exposure device.

The entire disclosure of Japanese Patent Application No.: 2014-014087, filed Jan. 29, 2014 and 2014-173624, filed Aug. 28, 2014 are expressly incorporated by reference herein.

What is claimed is:

1. An electro-optical device comprising:

a substrate having a rectangular shape;

an array region which is formed on the substrate and in which a plurality of light emitting pixels are arranged two-dimensionally;

a mounting terminal that is formed in a region different from the array region on the substrate;

a first drive line connected to light emitting pixels that are arranged in a row direction;

a second drive line connected to light emitting pixels that are arranged in a column direction;

a drive circuit that supplies a drive signal to at least one of the first drive line and the second drive line;

an inspection terminal that is electrically connected to the drive circuit or the second drive line and that is disposed on a side different from a side on which the mounting terminal of the substrate is disposed;

an electrostatic protection circuit that is connected to the inspection terminal; and an insulating sealing film that covers a surface of the inspection terminal, wherein at least a part of the electrostatic protection circuit overlaps the inspection terminal in a plan view, and wherein the mounting terminal is not covered by the insulating sealing film that covers the surface of the inspection terminal.

2. The electro-optical device according to claim 1, further comprising:

an inspection circuit between the inspection terminal and the array region.

3. An electronic apparatus comprising:

the electro-optical device according to claim 2.

4. The electro-optical device according to claim 1, wherein the electrostatic protection circuit has a shape having an area larger than an area of the inspection terminal in a plan view.

5. An electronic apparatus comprising:

the electro-optical device according to claim 4.

6. The electro-optical device according to claim 1, wherein the mounting terminal is configured to be electrically connected to an external circuit, and wherein the inspection terminal is configured to be contacted with an inspection probe during manufacture of the electro-optical device.

7. An electronic apparatus comprising:

the electro-optical device according to claim 6.

8. The electro-optical device according to claim 1, wherein the inspection terminal is disposed on three other sides different from the side on which the mounting terminal is disposed.

9. An electronic apparatus comprising:

the electro-optical device according to claim 8.

10. The electro-optical device according to claim 1, wherein the electrostatic protection circuit is formed in a layer lower than the inspection terminal, and wherein a plurality of insulating layers exist between the electrostatic protection circuit and the inspection terminal which overlap in a plan view.

11. An electronic apparatus comprising:

the electro-optical device according to claim 10.

12. The electro-optical device according to claim 1, wherein the electrostatic protection circuit has a transistor, and wherein a source of the transistor is connected to the inspection terminal, and a gate and a drain are connected to a substrate potential.

13. An electronic apparatus comprising:

the electro-optical device according to claim 12.

14. An electronic apparatus comprising:

the electro-optical device according to claim 1.

* * * * *